United States Patent [19]

Abeyama et al.

[11] 4,326,886

[45] Apr. 27, 1982

[54] STEEL FOR COLD FORGING HAVING GOOD MACHINABILITY AND THE METHOD OF MAKING THE SAME

[75] Inventors: Shozo Abeyama, Chita; Makoto Saito, Nagoya; Atsuyoshi Kimura, Handa; Sadayuki Nakamura, Chita, all of Japan

[73] Assignee: Daido Tokushuko Kabushiki Kaisha, Nagoya, Japan

[21] Appl. No.: 130,529

[22] Filed: Mar. 14, 1980

[30] Foreign Application Priority Data

Mar. 14, 1979 [JP] Japan ..... 54-28619

[51] Int. Cl.[3] ..... C22C 38/60

[52] U.S. Cl. ..... 75/129; 75/123 AA; 75/126 M; 75/126 P; 75/128 P

[58] Field of Search ..... 75/123 AA, 126 M, 126 P, 75/128 P, 129

[56] References Cited

U.S. PATENT DOCUMENTS

| | | | |
|---|---|---|---|
| 3,152,889 | 10/1964 | Holowaty | 75/123 AA |
| 3,152,890 | 10/1964 | Holowaty | 75/123 AA |
| 3,169,857 | 2/1965 | Rathke et al. | 75/123 AA |
| 3,600,158 | 8/1971 | Molnar et al. | 75/126 M |
| 3,634,074 | 1/1972 | Ito et al. | 75/126 M |
| 4,032,333 | 6/1977 | Josefsson | 75/123 AA |

*Primary Examiner*—W. Stallard

*Attorney, Agent, or Firm*—Armstrong, Nikaido, Marmelstein & Kubovcik

[57] ABSTRACT

A steel for cold forging containing C up to 0.6%, Si up to 0.5%, Mn up to 2.0%, S 0.003 to 0.04% and Te up to 0.03%, wherein ratio %Te/%S being at least 0.04, and further, Al up to 0.04%, N up to 0.02% and O up to 0.0030%, and the balance being substantially Fe exhibits both good formability in cold forging and good machinability.

The steel may further contain one or more of additional alloying elements selected from the group of Ni, Cr and Mo, the group of V, Nb, Ti, B and Zr, and the group of Pb, Se, Bi and Ca.

The steel for cold forging having good machinability is made preferably by agitating molten steel containing adjusted amounts of the alloying elements other than Te, and, if used, members of the Pb group, by introducing non-oxidizing gas thereinto so as to float up and separate large sized particles of non-metallic inclusions, and subsequently adding predetermined amount of Te and other elements.

1 Claim, 6 Drawing Figures

Figure 1:
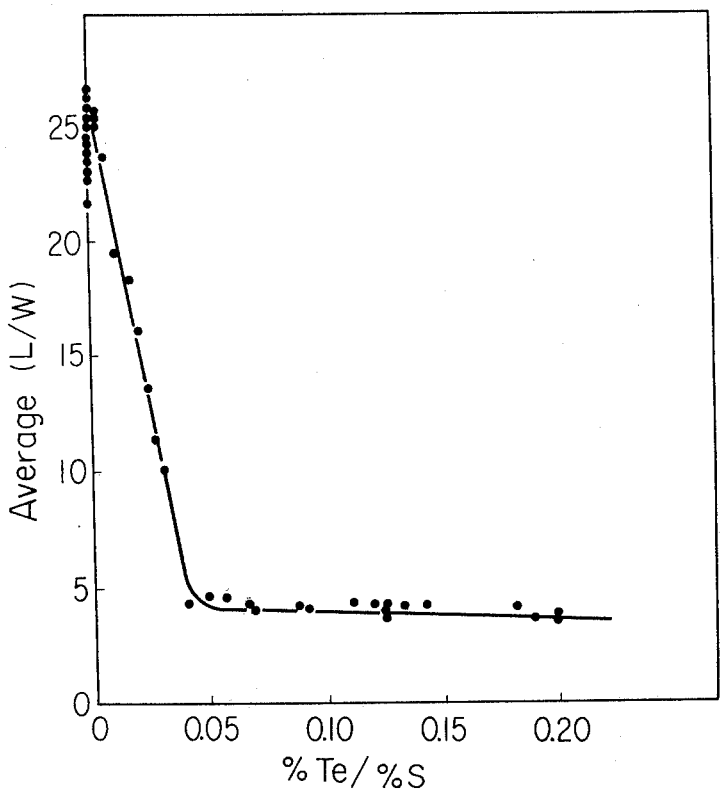

FIG. IIA
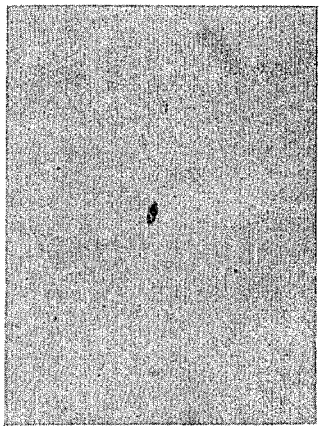
FIG. IIB
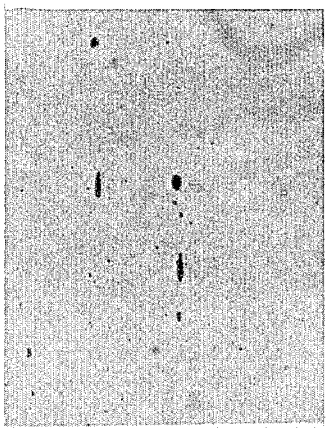
FIG. IIC
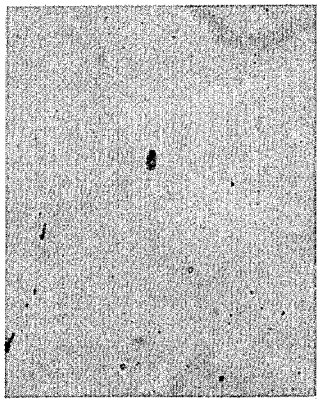
FIG. IID
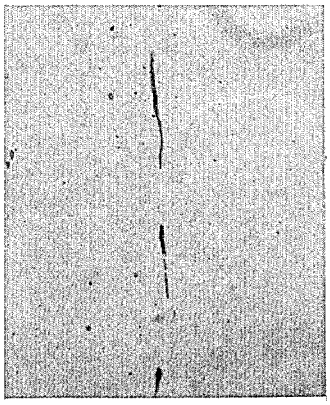
FIG. IIE
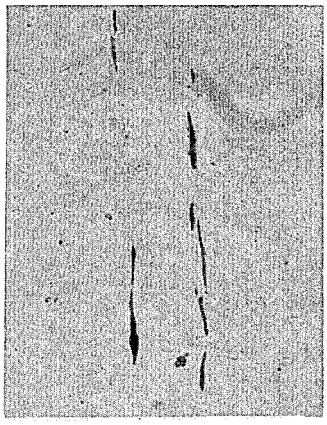

STEEL FOR COLD FORGING HAVING GOOD MACHINABILITY AND THE METHOD OF MAKING THE SAME

BACKGROUND OF THE INVENTION

1. Field of the Invention

The present invention relates to a novel steel for cold forging having both good formability in cold forging and good machinability. The invention encompasses a preferable method of making the steel for cold forging.

This invention is applicable to various steels such as machine structural carbon steel, manganese steel, chromium steel, molybdenum steel, chromium-molybdenum steel, nickel-chromium steel, nickel-chromium-molybdenum steel, manganese-chromium steel, and nickel-molybdenum steel.

2. State of the Art

Sulfur has been known as an element which deteriorates formability in cold forging of steels. Sulfur in the steel exists as sulfides such as MnS, which are easily extended along the forging direction to become strand-form, and the elongated sulfides are believed to be harmful to the formability in cold forging. Accordingly, conventional production of a steel for cold forging includes a step of desulfurization to form a low-sulfur steel. Low-sulfur steels, however, have relatively low machinability.

We have sought ways of solving the above problem and studied compositions of the steel for cold forging. As a result, we found that, when Te is added to a sulfur-containing steel in an amount where the ratio %Te/%S is at least 0.04, the elongation of the sulfides is remarkably suppressed, and therefore, that the steel has decreased anisotropy in mechanical properties, fairly good formability in cold forging and excellent machinability which is equivalent to, or even better than that of conventional sulfur-containing free cutting steels. Our discovery was disclosed in the U.S. patent application Ser. No. 77,477.

However, there has been further demand for a steel having more highly improved formability in cold forging with sufficient machinability.

SUMMARY OF THE INVENTION

An object of this invention is to provide steels for structural use having both further improved formability in cold forging and machinability.

Another object of the invention is to provide a preferable method of making the above steels.

The present invention is based on our discovery that formability in cold forging of sulfur-containing free cutting steels can be remarkably improved without sacrificing the machinability even at a low sulfur content such as less than 0.04%, if Te is added to the steel so that %Te/%S may be at least 0.04, and if the contents of oxygen and nitrogen are controlled to limited extents.

The invention is further based on our discovery that the formability of the above steels in cold forging can be further improved by choosing a low content of Al to prevent formation of $Al_2O_3$ in the steel.

DRAWINGS

FIG. I is a graph showing influence of the ratio %Te/%S on the form of the sulfide particles in the steel.

FIGS. IIA, IIB, IIC, IID and IIE are microscopic photographs showing distribution of the sulfide particles in the steel.

PREFERRED EMBODIMENTS OF THE INVENTION

The steel of this invention for cold forging having good machinability comprises basically: C up to 0.6%, Si up to 0.5%, Mn up to 2.0%, S 0.003 to 0.04% and Te up to 0.03, wherein %Te/%S is at least 0.04, and Al up to 0.04%, and the balance substantially of Fe. Preferably, the oxygen content should be up to 0.0030%, and nitrogen, up to 0.02%.

In the above basic composition, steels of particularly fine crystal grains contain Al 0.01 to 0.04%.

On the other hand, steels of better formability in cold forging contains less than 0.01% of Al.

Roles of the above noted alloying elements and significance of the composition are as follows:

C: up to 0.6%

Carbon is essential for assuring strength to the steel. Carbon content of more than 0.6% affects toughness, which is an important property of a structural material, and formability in cold forging.

Si: up to 0.5%

Silicon is added as a deoxidizing element to steels. It prevents occurrence of surface defects of cast steel. Because an excess amount of Si decreases toughness and hardens the matrix to damage the formability in cold forging, the content should be limited to 0.5%.

Mn: up to 2.0%.

Manganese promotes hardenability, increases strength, and further, forms sulfides, MnS, to arrest hot enbrittlement. However, too much, manganese will reduce machinability, and so, it is used in an amount up to 2.0%.

S: 0.003 to 0.04%

As noted, sulfur improves machinability of the steel, and is necessary to be contained in an amount of usually 0.003% or more to get sufficient machinability-improving effect. In view of lowered formability in cold forging of a large content, the upper limit has been determined to be 0.04%.

Te: up to 0.03%

In a steel containing S up to 0.04%, it is necessary to add a sufficient amount of Te to effectively prevent elongation of sulfides, such as MnS. However, favorable effect of a large content of Te on the improvement of the formability in cold forging is not so high, and thus, the upper limit is determined at 0.03%.

%Te/%S: at least 0.04.

In order to prevent elongation of sulfides, the ratio %Te/%S should be at least 0.04. This is supported by the data of the working examples noted below and shown in FIG. 1.

O: up to 0.0030%

Oxygen is harmful element because it forms oxides, particles of which act as the starting points of inner cracks during cold forging. In order to fully enjoy the effect of Te on improving formability in cold forging, the content of oxygen must be kept at the highest of 0.0030%. In case of particularly high reductions of area, it is preferable to lower the oxygen content as low as 0.0020% or less.

N: up to 0.02%

Nitrogen increases deformation resistance of the steel and decreases formability in cold forging, and therefore, its content should be as low as possible. The upper limit is 0.02% in usual cases, preferably less than 0.015% in case of extremely high reductions of area in cold forging.

Al: up to 0.040%

Aluminum is added as an deoxidizing agent, and is effective in controlling grain size. The effect can be remarkable at a content at 0.01% or higher. If, however, too much is contained, it reduces fluidity of molten steel. The upper limit of 0.040% is determined from this point of view.

On the other hand, aluminum combines with oxygen to form hard $Al_2O_3$, particles of which tend to be starting points of inner cracks occurring during cold forging. Alumina also abrades tools at machining of the steel products. From this point of view, a content less than 0.01% is preferable. In case of higher reductions of area in cold forging, it is preferable to decrease the content as low as 0.007% or less.

To the above noted basic composition, the following alloying elements may be added, if desired: One or more of the elements selected from the group of: Ni: up to 4.5%, Cr: up to 3.5% and Mo: up to 1.0%.

The above three elements are useful in the present steel to highten the toughness and anti-temperbility. At a higher contents thereof, the effect of addition is not proportional, and therefore, it is advantageous to add optionally in an amount in the given limits. One or more of the elements selected from the group of: V up to 0.2%, Nb up to 0.1%, Ti up to 0.1%, B up to 0.01% and Zr up to 0.2%.

These elements are useful for improving crystal structure and properties for heat treatment of the steel. In order to maintain the merit of good formability in cold forging due to less elongation of the sulfide particles, the addition amount should be chosen in the above noted limits. It was affirmed by the data of the Examples shown below, that the effect of adding these elements is, available also in cases with the elements of the other group, namely, Ni-group and Pb-group below. One or more of the elements selected from the group of: Pb 0.01 to 0.30%, Se 0.003 to 0.10%, Bi 0.01 to 0.30% and Ca 0.0002 to 0.01%.

These elements are effective for improving machinability. The effect can be obtained at a content higher than the lower limits, and the upper limits are set so that the formability in cold forging of the steel may be kept high.

As noted above, the present invention encompasses a preferable method of making the above described steel for cold forging having good machinability.

The method comprises the steps of:

preparing a molten steel containing adjusted amounts of C, Si, Mn and S, and optionally, the above listed additional element or elements except for those of Pb-group in a furnace or a ladle, at the time of degassing or after the degassing of the molten steel, or at the time of refining with addition of Al, if performed, agitating the molten steel by introducing non-oxidizing gas thereinto so as to float and separate large particles of non-metallic inclusions into slug, and then adding predetermined amount of Te, and if necessary, one or more of the elements of the Pb-group to uniformly disperse in the molten steel, followed by conventional casting and hot working.

The present invention will now be illustrated with working examples.

EXAMPLE I

Steels having the compositions indicated in Table I were prepared by adjusting contents of alloying elements other than Te, Bi and Ca in molten steels in an arc-furnace, which molten steels were then poured into a vacuum degassing vessel and degassed.

The degassed molten steel was then poured into a ladle having a porous plug at the bottom, and Al was added in a predetermined amount thereto.

Under agitation of the molten steels by blowing argon gas through porous plug at the bottom of the ladle, Te was added in various amounts corresponding to the contents of S to give ratio %Te/%S of at least 0.04. Then, a certain amounts of Pb, Bi and Ca were added to some batches. If desired, Te, Bi, Pb and Ca could be added to stream of the molten steels during pouring them into the ladle.

The molten steels were cast into 1.3 ton-ingots by bottom pouring. Te, Pb, and Bi could by added to stream of the molten steels to be cast.

The ingots were then hot rolled at a finish rolling temperature of 950° C. to achieve forging ratio of about 100 or higher.

Specimens for various tests were taken from the steel products thus obtained.

TABLE I

| Steel Mark | Run | C | Si | Mn | S | Te | % Te/% S | O | N | Al | Ni | Cr | Mo | B,V,Ti, Nb,Zr | Pb,Se, Bi,Ca | L/w |
|---|---|---|---|---|---|---|---|---|---|---|---|---|---|---|---|---|
| JIS S10C | | | | | | | | | | | | | | | | |
| | 1 | 0.10 | 0.19 | 0.42 | 0.025 | 0.001 | 0.040 | 0.0015 | 0.010 | 0.035 | — | — | — | — | — | 4.1 |
| | 2 | 0.09 | 0.21 | 0.50 | 0.034 | 0.007 | 0.206 | 0.0012 | 0.009 | 0.030 | — | — | — | Zr:0.17 | — | 3.6 |
| | 3 | 0.11 | 0.22 | 0.44 | 0.031 | 0.018 | 0.581 | 0.0014 | 0.010 | 0.034 | — | — | — | — | Pb:0.28 | 3.1 |
| | 4 | 0.11 | 0.20 | 0.45 | 0.028 | 0.019 | 0.679 | 0.0025 | 0.010 | 0.033 | — | — | — | — | Bi:0.29 | 3.1 |
| | 5 | 0.09 | 0.30 | 0.48 | 0.034 | 0.010 | 0.294 | 0.0013 | 0.009 | 0.034 | — | — | — | Nb:0.07 | Ca:0.0032 | 3.2 |
| | 6 | 0.10 | 0.23 | 0.44 | 0.030 | 0.009 | 0.300 | 0.0019 | 0.009 | 0.034 | — | — | — | Ti:0.09 | Pb:0.14 Ca:0.0015 | 3.1 |
| | 7* | 0.10 | 0.25 | 0.47 | 0.030 | — | — | 0.0112 | 0.010 | 0.032 | — | — | — | — | — | 21.5 |
| JIS S55C | | | | | | | | | | | | | | | | |
| | 8 | 0.54 | 0.21 | 0.71 | 0.004 | 0.011 | 2.750 | 0.0014 | 0.008 | 0.015 | — | — | — | — | — | 3.0 |
| | 9 | 0.53 | 0.21 | 0.69 | 0.015 | 0.014 | 0.933 | 0.0013 | 0.009 | 0.018 | — | — | — | B:0.0024 Ti:0.04 | — | 3.1 |
| | 10 | 0.55 | 0.20 | 0.69 | 0.011 | 0.005 | 0.455 | 0.0013 | 0.008 | 0.020 | — | — | — | Zr:0.09 | — | 3.3 |
| | 11 | 0.56 | 0.19 | 0.70 | 0.016 | 0.002 | 0.125 | 0.0010 | 0.009 | 0.019 | — | — | — | Nb:0.04 Ti:0.02 | — | 3.5 |
| | 12 | 0.55 | 0.21 | 0.81 | 0.012 | 0.006 | 0.500 | 0.0008 | 0.008 | 0.021 | — | — | — | — | Pb:0.08 | 3.1 |
| | 13 | 0.56 | 0.18 | 0.66 | 0.007 | 0.014 | 2.000 | 0.0009 | 0.008 | 0.015 | — | — | — | — | Pb:0.05 Ca:0.0088 | 3.3 3.3 |
| | 14 | 0.54 | 0.18 | 0.70 | 0.008 | 0.010 | 1.250 | 0.0008 | 0.009 | 0.018 | — | — | — | Zr:0.05 Ti:0.07 | Se:0.095 | 3.3 |

TABLE I-continued

| Steel Mark | Run | C | Si | Mn | S | Te | % Te/ % S | O | N | Al | Ni | Cr | Mo | B,V,Ti, Nb,Zr | Pb,Se, Bi,Ca | L/w |
|---|---|---|---|---|---|---|---|---|---|---|---|---|---|---|---|---|
| | 15 | 0.55 | 0.19 | 0.72 | 0.008 | 0.008 | 1.000 | 0.0012 | 0.008 | 0.016 | — | — | — | Nb:0.01 | Ca:0.0011 | 3.2 |
| JIS S550 | | | | | | | | | | | | | | | | |
| | 16* | 0.56 | 0.19 | 0.68 | 0.013 | — | — | 0.0052 | 0.008 | 0.014 | — | — | — | — | — | 25.1 |
| | 17* | 0.56 | 0.19 | 0.77 | 0.015 | — | — | 0.0015 | 0.009 | 0.058 | — | — | — | B:0.0052 Ti:0.006 | — | 26.3 |
| JIS SMn21 | | | | | | | | | | | | | | | | |
| | 18 | 0.20 | 0.19 | 1.22 | 0.009 | 0.006 | 0.667 | 0.0012 | 0.008 | 0.025 | — | — | — | — | — | 3.2 |
| | 19 | 0.21 | 0.22 | 1.29 | 0.008 | 0.004 | 0.500 | 0.0014 | 0.009 | 0.031 | — | — | — | B:0.0019 Ti:0.04 Nb:0.05 | — | 3.2 |
| | 20 | 0.19 | 0.25 | 1.27 | 0.011 | 0.001 | 0.091 | 0.0009 | 0.010 | 0.028 | — | — | — | Ti:0.03 | — | 3.9 |
| | 21 | 0.19 | 0.22 | 1.28 | 0.015 | 0.009 | 0.600 | 0.0009 | 0.010 | 0.028 | — | — | — | — | Pb:0.15 Bi:0.13 | 3.4 |
| | 22 | 0.21 | 0.21 | 1.25 | 0.010 | 0.018 | 1.800 | 0.0008 | 0.007 | 0.029 | — | — | — | V:0.20 Zr:0.10 | Bi:0.10 Se:0.025 | 3.3 |
| | 23* | 0.22 | 0.23 | 1.26 | 0.014 | — | — | 0.0048 | 0.008 | 0.045 | — | — | — | — | — | 23.4 |
| | 24* | 0.21 | 0.23 | 1.29 | 0.015 | — | — | 0.0044 | 0.025 | 0.035 | — | — | — | B:0.0021 Ti:0.05 | — | 23.0 |
| JIS SCr4 | | | | | | | | | | | | | | | | |
| | 25 | 0.41 | 0.20 | 0.71 | 0.009 | 0.002 | 0.222 | 0.0011 | 0.008 | 0.024 | — | 1.02 | — | — | — | 3.8 |
| | 26 | 0.40 | 0.19 | 0.72 | 0.010 | 0.008 | 0.800 | 0.0013 | 0.009 | 0.022 | — | 0.91 | — | B:0.0032 Ti:0.04 | — | 3.7 |
| | 27 | 0.39 | 0.25 | 0.72 | 0.029 | 0.002 | 0.069 | 0.0016 | 0.010 | 0.023 | — | 1.04 | — | V:0.12 | — | 3.8 |
| | 28 | 0.40 | 0.22 | 0.69 | 0.012 | 0.015 | 1.25 | 0.0014 | 0.009 | 0.023 | — | 1.00 | — | Nb:0.06 | — | 3.1 |
| | 29 | 0.38 | 0.20 | 0.70 | 0.014 | 0.019 | 1.357 | 0.0012 | 0.009 | 0.025 | — | 0.99 | — | — | Pb:0.19 | 3.1 |
| | 30 | 0.39 | 0.21 | 0.69 | 0.013 | 0.003 | 0.231 | 0.0010 | 0.008 | 0.025 | — | 1.05 | — | — | Se:0.059 | 3.8 |
| | 31 | 0.39 | 0.20 | 0.73 | 0.015 | 0.006 | 0.400 | 0.0009 | 0.007 | 0.021 | — | 1.07 | — | — | Bi:0.04 Ca:0.0093 | 3.3 |
| | 32 | 0.41 | 0.19 | 0.72 | 0.010 | 0.003 | 0.300 | 0.0008 | 0.009 | 0.019 | — | 1.19 | — | B:0.0044 Ti:0.06 | Ca:0.0028 | 3.6 |
| | 33* | 0.42 | 0.23 | 0.78 | 0.029 | — | — | 0.0015 | 0.010 | .02 | — | 1.04 | — | — | — | 24.1 |
| | 34* | 0.43 | 0.21 | 0.71 | 0.014 | — | — | 0.0041 | 0.011 | 0.022 | — | 0.92 | — | B:0.0044 Ti:0.06 | — | 24.9 |
| | 35* | 0.40 | 0.22 | 0.75 | 0.015 | — | — | 0.0063 | 0.015 | 0.025 | — | 1.18 | — | V:0.11 | — | 22.6 |
| JIS SNC2 | | | | | | | | | | | | | | | | |
| | 36 | 0.29 | 0.20 | 0.41 | 0.025 | 0.003 | 0.120 | 0.0013 | 0.009 | 0.025 | 2.35 | 0.78 | — | — | — | 4.0 |
| | 37 | 0.30 | 0.19 | 0.42 | 0.021 | 0.004 | 0.190 | 0.0010 | 0.008 | 0.024 | 2.66 | 0.76 | — | B:0.0049 | — | 3.4 |
| | 38 | 0.30 | 0.25 | 0.40 | 0.015 | 0.009 | 0.600 | 0.0029 | 0.007 | 0.035 | 2.41 | 0.77 | — | Nb:0.05 Zr:0.12 | — | 3.8 |
| | 39 | 0.31 | 0.22 | 0.48 | 0.024 | 0.005 | 0.208 | 0.0008 | 0.008 | 0.029 | 2.53 | 0.69 | — | — | Pb:0.05 Se:0.02 Ca:0.0063 | 3.8 |
| | 40 | 0.29 | 0.30 | 0.44 | 0.018 | 0.008 | 0.444 | 0.0009 | 0.008 | 0.039 | 2.49 | 0.88 | — | Ti:0.05 | Bi:0.06 | 3.3 |
| | 41* | 0.34 | 0.18 | 0.51 | 0.027 | — | — | 0.0015 | 0.009 | 0.019 | 2.54 | 0.74 | — | — | — | 25.5 |
| JIS SNCM25 | | | | | | | | | | | | | | | | |
| | 42 | 0.41 | 0.22 | 0.50 | 0.020 | 0.001 | 0.050 | 0.0014 | 0.009 | 0.035 | 4.29 | 0.91 | 0.20 | — | — | 4.5 |
| | 43 | 0.15 | 0.21 | 0.41 | 0.015 | 0.003 | 0.200 | 0.0015 | 0.008 | 0.032 | 4.25 | 0.85 | 0.25 | V:0.01 Zr:0.06 | — | 3.6 |
| | 44 | 0.16 | 0.28 | 0.39 | 0.012 | 0.005 | 0.417 | 0.0020 | 0.011 | 0.028 | 4.30 | 0.72 | 0.23 | Nb:0.04 Ti:0.05 Zr:0.03 | — | 3.5 |
| | 45 | 0.15 | 0.23 | 0.41 | 0.015 | 0.002 | 0.133 | 0.0009 | 0.010 | 0.026 | 4.18 | 0.79 | 0.24 | — | Pb:0.06 Se:0.01 Ca:0.0008 | 3.9 |
| | 46 | 0.15 | 0.23 | 0.40 | 0.013 | 0.008 | 0.615 | 0.0012 | 0.009 | 0.029 | 4.24 | 0.86 | 0.23 | B:0.0033 Ti:0.005 Nb:0.04 | Bi:0.08 | 3.3 |
| | 47* | 0.16 | 0.31 | 0.43 | 0.008 | — | — | 0.0035 | 0.024 | 0.008 | 4.22 | 0.88 | 0.24 | — | — | 26.0 |
| JIS SCM22 | | | | | | | | | | | | | | | | |
| | 48 | 0.20 | 0.21 | 0.74 | 0.018 | 0.019 | 1.056 | 0.0014 | 0.009 | 0.030 | — | 1.05 | 0.24 | — | — | 3.0 |
| | 49 | 0.21 | 0.25 | 0.72 | 0.014 | 0.011 | 0.786 | 0.0013 | 0.008 | 0.026 | — | 1.04 | 0.18 | V:0.04 | — | 3.3 |
| | 50 | 0.21 | 0.23 | 0.73 | 0.012 | 0.005 | 0.417 | 0.0015 | 0.009 | 0.022 | — | 1.05 | 0.29 | Nb:0.06 | — | 3.2 |
| | 51 | 0.20 | 0.24 | 0.73 | 0.015 | 0.003 | 0.200 | 0.0012 | 0.009 | 0.027 | — | 1.11 | 0.20 | — | Pb:0.17 | 3.6 |
| | 52 | 0.19 | 0.26 | 0.72 | 0.017 | 0.008 | 0.471 | 0.0008 | 0.010 | 0.026 | — | 1.03 | 0.19 | — | Pb:0.06 Ca:0.0024 | 3.5 |
| | 53 | 0.21 | 0.26 | 0.73 | 0.016 | 0.002 | 0.125 | 0.0009 | 0.009 | 0.038 | — | 0.98 | 0.19 | — | Ca:0.0040 | 3.8 |
| | 54 | 0.21 | 0.23 | 0.78 | 0.017 | 0.006 | 0.353 | 0.0013 | 0.009 | 0.019 | — | 1.05 | 0.22 | Nb:0.04 | Ca:0.0029 | 3.4 |
| | 55 | 0.20 | 0.24 | 0.77 | 0.034 | 0.028 | 0.824 | 0.0014 | 0.009 | 0.023 | — | 1.07 | 0.23 | Nb:0.05 | Se:0.06 Ca:0.0015 | 3.6 |
| | 56* | 0.21 | 0.22 | 0.74 | 0.020 | — | — | 0.0035 | 0.010 | 0.025 | — | 1.02 | 0.22 | — | — | 25.4 |
| | 57* | 0.21 | 0.23 | 0.75 | 0.022 | — | — | 0.0056 | 0.010 | 0.003 | — | 1.06 | 0.21 | Nb:0.05 | Ca:0.0012 | 24.9 |
| JIS SMnC3 | | | | | | | | | | | | | | | | |
| | 58 | 0.43 | 0.23 | 1.44 | 0.014 | 0.002 | 0.143 | 0.0012 | 0.009 | 0.019 | — | 0.52 | — | — | — | 4.0 |
| | 59 | 0.42 | 0.25 | 1.46 | 0.010 | 0.003 | 0.300 | 0.0014 | 0.008 | 0.018 | — | 0.55 | — | B:0.0021 Ti:0.04 | — | 3.8 |
| | 60 | 0.42 | 0.25 | 1.45 | 0.009 | 0.001 | 0.111 | 0.0010 | 0.006 | 0.016 | — | 0.55 | — | V:0.05 Nb:0.07 Ti:0.08 | — | 4.1 |
| | 61 | 0.43 | 0.24 | 1.44 | 0.011 | 0.005 | 0.455 | 0.0012 | 0.101 | 0.021 | — | 0.55 | — | — | Ca:0.0064 | 3.4 |
| | 62 | 0.43 | 0.25 | 1.49 | 0.011 | 0.002 | 0.182 | 0.0026 | 0.015 | 0.027 | — | 0.54 | — | — | Bi:0.03 | 3.9 |

TABLE I-continued

| Steel Mark | Run | C | Si | Mn | S | Te | % Te/% S | O | N | Al | Ni | Cr | Mo | B,V,Ti, Nb,Zr | Pb,Se, Bi,Ca | L/w |
|---|---|---|---|---|---|---|---|---|---|---|---|---|---|---|---|---|
| | 63 | 0.43 | 0.22 | 1.41 | 0.014 | 0.009 | 0.643 | 0.0011 | 0.008 | 0.019 | — | 0.51 | — | Nb:0.04 | Ca:0.0018 Pb:0.03 Bi:0.07 | 3.5 |
| | 64 | 0.42 | 0.26 | 1.48 | 0.013 | 0.015 | 1.154 | 0.0014 | 0.009 | 0.022 | — | 0.58 | — | Ti:0.03 Zr:0.12 | Se:0.06 | 3.3 |
| | 65* | 0.44 | 0.24 | 1.48 | 0.018 | — | — | 0.0017 | 0.009 | 0.021 | — | 0.54 | — | — | — | 23.6 |
| | 66* | 0.42 | 0.24 | 1.44 | 0.026 | — | — | 0.0056 | 0.010 | 0.025 | — | 0.53 | — | B:0.0058 | — | 25.1 |
| 4032 | | | | | | | | | | | | | Ti:0.06 | | | |
| | 67 | 0.33 | 0.28 | 0.81 | 0.036 | 0.002 | 0.056 | 0.0013 | 0.009 | 0.021 | — | — | 0.25 | — | — | 4.4 |
| | 68 | 0.32 | 0.28 | 0.80 | 0.029 | 0.018 | 0.621 | 0.0009 | 0.011 | 0.025 | — | — | 0.26 | V:0.02 Ti:0.03 | — | 3.8 |
| | 69 | 0.33 | 0.29 | 0.79 | 0.038 | 0.012 | 0.316 | 0.0010 | 0.010 | 0.019 | — | — | 0.25 | Zr:0.10 | — | 3.8 |
| | 70 | 0.31 | 0.27 | 0.83 | 0.034 | 0.003 | 0.088 | 0.0012 | 0.008 | 0.020 | — | — | 0.25 | — | Pb:0.05 Bi:0.01 Ca:0.0005 | 4.0 |
| | 71 | 0.34 | 0.28 | 0.82 | 0.028 | 0.016 | 0.571 | 0.0011 | 0.009 | 0.020 | — | — | 0.26 | Nb:0.22 | 3.5 | |
| | 72* | 0.35 | 0.27 | 0.82 | 0.031 | — | — | 0.0015 | 0.011 | 0.025 | — | — | 0.24 | — | — | 22.8 |
| 4621 | | | | | | | | | | | | | | | | |
| | 73 | 0.20 | 0.25 | 0.79 | 0.030 | 0.002 | 0.067 | 0.0014 | 0.009 | 0.025 | 1.81 | — | 0.22 | — | — | 4.1 |
| | 74 | 0.21 | 0.27 | 0.81 | 0.015 | 0.005 | 0.333 | 0.0014 | 0.009 | 0.036 | 1.82 | — | 0.24 | B:0.0085 Ti:0.04 Zr:0.04 | — | 3.7 |
| | 75 | 0.21 | 0.30 | 0.83 | 0.016 | 0.002 | 0.125 | 0.0012 | 0.008 | 0.024 | 1.7 | — | 0.26 | — | Pb:0.07 Ca:0.0016 | 4.0 |
| | 76 | 0.20 | 0.28 | 0.82 | 0.021 | 0.009 | 0.429 | 0.0013 | 0.009 | 0.018 | 1.85 | — | 0.25 | — | Ca:0.0038 | 3.6 |
| | 77 | 0.22 | 0.28 | 0.82 | 0.015 | 0.003 | 0.222 | 0.0011 | 0.009 | 0.012 | 1.79 | — | 0.24 | Zr:0.11 | Bi:0.06 Ca:0.0019 | 3.5 |
| | 78* | 0.20 | 0.31 | 0.85 | 0.039 | — | — | 0.0032 | 0.009 | 0.051 | 1.80 | — | 0.24 | — | — | 24.0 |

(1) Form of the sulfides

Inspection was made on the sulfides inclusions in the steel by measuring length(L) and width(W) of 200 particles of the sulfides in a definite field of microscope. Averages of L/W, or aspect ratios, were recorded in Table I. The majority of the sulfide inclusion is MnS.

The relation between %Te/%S ratios and the aspect ratios is shown in FIG. 1.

As seen from FIG. I, %Te/%S ratios larger than 0.04 give aspect ratio of sulfide particles of 5 or less.

Microscopic photographs were taken to record the form of sulfide particles in some of the above specimens after hot rolling (forging ratio:about 170), and shown as FIGS. IIA, IIB, IIC, IID and IIE.

The specimens are of:

| FIG. | Steel Mark | Run No. |
|---|---|---|
| IIA | S10C | 1 |
| IIB | S10C | 2 |
| IIC | SMn21 | 18 |
| IID | S10C | 7 |
| IIE | SMn21 | 23 |

The photographs show that the sulfides in the steel of this invention are in the form of a spindle, while those in the conventional steels are highly elongated form in rolling direction.

In Tables I and V, the abbreviation "L/W" means the above aspect ratio of a sulfide particle.

Runs with asterisk are control examples.

The numbers of JISs defining composition of the steels in the Tables are as listed below:

| Steel Marks | JIS Number |
|---|---|
| S10C, S55C | G 4051 |
| SMn21, SMnC3 | G 4106 |
| SCr4 | G 4104 |

-continued

| Steel Marks | JIS Number |
|---|---|
| SNC1, SNC2 | G 4102 |
| SNCM25 | G 4103 |
| SCM22, SCM23 | G 4105 |

(2) Formability in cold forging

For the purpose of evaluating formability in cold forging of the specimens, test pieces ($\phi$:30×50 mm) were taken from the specimens. The test pieces were subjected to upset, or cold forging test at 4 different levels of reduction of height, 60%, 65%, 70% and 75%. The upset pieces were then inspected with a microscope at magnifications 20 as to whether the pieces have inner cracks. Percentages of number of pieces which contain a crack among all the pieces at each level (200 pieces per level) are shown in Table II as "Occurrence of inner crack".

The table teaches that the occurrences of inner crack of the present steels are significantly lower than those of the conventional steels. Thus, the steel according to the invention is concluded to have good formability in cold forging.

TABLE II

| Steel Mark | Run | Heat Treatment | Occurrence of Crack in Cold Forging (%) at various Reductions of height (%) 60 | 65 | 70 | 75 |
|---|---|---|---|---|---|---|
| JIS S10C | | | | | | |
| | 1 | | 0 | 0 | 0 | 0 |
| | 2 | | 0 | 0 | 0 | 0 |
| | 3 | | 0 | 0 | 0 | 0.5 |
| | 4 | As Rolled | 0 | 0 | 0.5 | 2.5 |
| | 5 | | 0 | 0 | 0 | 0 |
| | 6 | | 0 | 0 | 0.5 | 2.0 |
| | 7* | | 12.0 | 41.5 | 85.0 | 100 |
| JIS S55C | | | | | | |
| | 8 | | 0 | 0 | 0 | 12.0 |
| | 9 | | 0 | 0 | 0 | 7.5 |

TABLE II-continued

| Steel Mark | Run | Heat Treatment | Occurrence of Crack in Cold Forging (%) at various Reductions of height (%) 60 | 65 | 70 | 75 |
|---|---|---|---|---|---|---|
| | 10 | | 0 | 0 | 0 | 5.5 |
| | 11 | Spheroidizing Annealing, | 0 | 0 | 0 | 8.5 |
| | 12 | 750° C. F.C. | 0 | 0 | 0.5 | 10.5 |
| | 13 | | 0 | 0 | 0 | 9.0 |
| | 14 | | 0 | 0 | 1.0 | 11.0 |
| | 15 | | 0 | 0 | 0 | 6.0 |
| | 16* | Spheroidizing Annealing, | 9.5 | 35.0 | 87.0 | 100 |
| | 17* | 750° C. F.C. | 0 | 29.5 | 76.5 | 100 |
| JIS SMn21 | | | | | | |
| | 18 | | 0 | 0 | 0 | 1.0 |
| | 19 | | 0 | 0 | 0 | 1.5 |
| | 20 | | | 0 | 0 | 0.5 |
| | 21 | As Rolled | 0 | 0 | 0 | 4.0 |
| | 22 | | 0 | 0 | 0 | 5.5 |
| | 23* | | 11.0 | 12.5 | 62.5 | 97.0 |
| | 24* | | 6.5 | 25.0 | 75.5 | 100 |
| JIS SCr 4 | | | | | | |
| | 25 | | 0 | 0 | 0 | 5.5 |
| | 26 | | 0 | 0 | 0 | 7.0 |
| | 27 | Spheroidizing Annealing, | 0 | 0 | 35 | 15.0 |
| | 28 | 770° C. F.C. | 0 | 0 | 0 | 6.0 |
| | 29 | | 0 | 0 | 0 | 16.5 |
| | 30 | | 0 | 0 | 0 | 8.0 |
| | 31 | | 0 | 0 | 0 | 7.5 |
| | 32 | | 0 | 0 | 0 | 6.5 |
| | 33* | Spheroidizing Annealing, | 0 | 53.0 | 91.5 | 100 |
| | 34* | 770° C. F.C. | 22.0 | 35.5 | 77.5 | 100 |
| | 35* | | 14.5 | 29.0 | 78.0 | 100 |
| JIS SNC2 | | | | | | |
| | 36 | | 0 | 0 | 0 | 0 |
| | 37 | | 0 | 0 | 0 | 0 |
| | 38 | Annealing, | 0 | 0 | 0.5 | 5.0 |
| | | 820° C. F.C. | 0 | 0 | 0.5 | 5.0 |
| | 39 | | 0 | 0 | 0 | 4.0 |
| | 40 | | 0 | 0 | 0 | 3.5 |
| | 41* | | 0 | 15.5 | 62.5 | 100 |
| JIS SCM25 | | | | | | |
| | 42 | | 0 | 0 | 0 | 0 |
| | 43 | As Rolled | 0 | 0 | 0 | 0 |
| | 44 | | 0 | 0 | 0 | 2.0 |
| | 45 | | 0 | 0 | 0 | 5.5 |
| | 46 | As Rolled | 0 | 0 | 0 | 8.0 |
| | 47* | | 5.5 | 7.5 | 33.0 | 79.5 |
| JIS SCM22 | | | | | | |
| | 48 | | 0 | 0 | 0 | 0 |
| | 49 | | 0 | 0 | 0 | 0 |
| | 50 | | 0 | 0 | 0 | 0 |
| | 51 | | 0 | 0 | 0 | 6.0 |
| | 52 | As Rolled | 0 | 0 | 0 | 1.5 |
| | 53 | | 0 | 0 | 0 | 0 |
| | 54 | | 0 | 0 | 0 | 0 |
| | 55 | | 0 | 0 | 0 | 11.0 |
| | 56* | | 14.0 | 22.0 | 61.0 | 98.5 |
| | 57* | | 25.0 | 47.5 | 75.0 | 100 |
| JIS SMnC3 | | | | | | |
| | 58 | | 0 | 0 | 0 | 8.5 |
| | 59 | | 0 | 0 | 0 | 10.0 |
| | 60 | | 0 | 0 | 0 | 11.0 |
| | 61 | Spheroidizing Annealing, | 0 | 0 | 0 | 7.5 |
| | 62 | 750° C. F.C. | 0 | 0 | 2.5 | 19.5 |
| | 63 | | 0 | 0 | 0 | 15.5 |
| | 64 | | 0 | 0 | 0 | 11.5 |
| | 65* | | 0 | 48.0 | 86.0 | 100 |
| | 66* | | 35.0 | 63.5 | 99.0 | 100 |
| 4032 | | | | | | |
| | 67 | | 0 | 0 | 0 | 11.5 |
| | 68 | | 0 | 0 | 0 | 15.0 |
| | 69 | Annealing, 830° C. F.C. | 0 | 0 | 0 | 10.0 |
| | 70 | | 0 | 0 | 0.5 | 18.0 |
| | 71 | | 0 | 0 | 1.5 | 22.0 |
| | 72* | | 45.0 | 82.0 | 100 | 100 |

TABLE II-continued

| Steel Mark | Run | Heat Treatment | Occurrence of Crack in Cold Forging (%) at various Reductions of height (%) 60 | 65 | 70 | 75 |
|---|---|---|---|---|---|---|
| 4621 | | | | | | |
| | 73 | | 0 | 0 | 0 | 0 |
| | 74 | | 0 | 0 | 0 | 0 |
| | 75 | As Rolled | 0 | 0 | 0 | 2.0 |
| | 76 | | 0 | 0 | 0 | 0 |
| | 77 | | 0 | 0 | 0 | 3.5 |
| | 78* | | 39.5 | 45.0 | 100 | 100 |

(3) Machinability

In order to evaluate machinability of the specimens, they were heat treated and subjected to drilling and lathing tests under the testing conditions shown in Table III.

The test results are given in Table IV.

TABLE III

| | |
|---|---|
| Tool life test with Hss twist drill | |
| Drill: | SKH 9, straight shank drill, 0 (diameter) 5.0mm |
| Feed: | 0.10 mm/rev. |
| Depth of hole: | 20 mm, (blind hole) |
| Cutting speed: | 30 mm/min. |
| Cutting oil: | none |
| Criterion of tool life: | Accumulated depth of hole until the drill no longer cuts |
| Tool life test with carbide single point tool | |
| Tool: | P10 (−5,—5,5,5,30,0,0.4) |
| Feed: | 0.20 mm/rev. |
| Depth of cutting: | 2.0 mm |
| Cutting speed: 200 mm/min. | |
| Cutting oil: | none |
| Criterion of tool life: | Accumulated length of cutting time until abrasion of flank reached 0.2 mm. |

TABLE IV

| Steel Mark | Run | Heat Treatment | Tool Life of Hss Twist Drill (mm) | Tool Life of Carbide single Point Tool (min.) |
|---|---|---|---|---|
| JIS S10C | | | | |
| | 1 | | 37000 | 51 |
| | 2 | | 31200 | 48 |
| | 3 | | 96300 | 55 |
| | 4 | 900° C., A.C. | 92700 | 52 |
| | 5 | | 35800 | 116 |
| | 6 | | 56100 | 120 |
| | 7* | | 13000 | 35 |
| JIS S55C | | | | |
| | 8 | | 360 | 15 |
| | 9 | | 320 | 14 |
| | 10 | | 300 | 14 |
| | 11 | | 300 | 15 |
| | 12 | | 540 | 21 |
| | 13 | 850° C., A.C. | 460 | 48 |
| | 14 | | 520 | 18 |
| | 15 | | 340 | 46 |
| | 16* | 850° C., A.C. | 100 | 10 |
| | 17* | | 80 | 9 |
| JIS SMn21 | | | | |
| | 18 | | 3400 | 21 |
| | 19 | | 3260 | 19 |
| | 20 | | 3280 | 20 |
| | 21 | 880° C., A.C. | 6640 | 31 |
| | 22 | | 5820 | 20 |
| | 23* | | 1200 | 13 |
| | 24* | | 1140 | 12 |
| JIS SCr4 | | | | |
| | 25 | | 360 | 35 |
| | 26 | | 360 | 34 |
| | 27 | 830° C., F.C. | 360 | 30 |

TABLE IV-continued

| Steel Mark | Run | Heat Treatment | Tool Life of Hss Twist Drill (mm) | Tool Life of Carbide single Point Tool (min.) |
|---|---|---|---|---|
| | 28 | | 340 | 35 |
| | 29 | | 1180 | 41 |
| | 30 | | 620 | 37 |
| | 31 | 830° C., F.C. | 540 | 84 |
| | 32 | | 340 | 78 |
| | 33* | | 120 | 22 |
| | 34* | | 120 | 22 |
| | 35* | | 80 | 20 |
| JIS SNO2 | | | | |
| | 36 | | 560 | 17 |
| | 37 | | 560 | 16 |
| | 38 | 850° C., A.C. | 480 | 16 |
| | 39 | | 700 | 55 |
| | 40 | | 660 | 24 |
| | 41* | | 180 | 10 |
| JIS SCM22 | | | | |
| | 42 | | 3220 | 24 |
| | 43 | 850° C., A.C. | 2860 | 23 |
| | 44 | | 2680 | 23 |
| | 45 | 850° C., A.C. | 4900 | 56 |
| | 46 | | 4780 | 31 |
| | 47 | | 940 | 15 |
| | 48 | 870° C., A.C. | 5340 | 45 |
| | 49 | | 5060 | 44 |
| | 50 | | 5280 | 45 |
| | 51 | | 18600 | 60 |
| | 52 | | 9260 | 53 |
| | 53 | | 5300 | 91 |
| | 54 | | 5140 | 90 |
| | 55 | | 7760 | 103 |
| | 56* | | 1720 | 29 |
| | 57* | | 1680 | 40 |
| JIS SMnC3 | | | | |
| | 58 | | 300 | 10 |
| | 59 | | 280 | 9 |
| | 60 | | 300 | 8 |

TABLE IV-continued

| Steel Mark | Run | Heat Treatment | Tool Life of Hss Twist Drill (mm) | Tool Life of Carbide single Point Tool (min.) |
|---|---|---|---|---|
| | 61 | 870° C., A.C. | 320 | 15 |
| | 62 | | 420 | 20 |
| | 63 | | 960 | 17 |
| | 64 | | 600 | 12 |
| | 65* | | 80 | 5 |
| | 66* | | 80 | 4 |
| 4032 | | | | |
| | 67 | | 420 | 7 |
| | 68 | | 400 | 7 |
| | 69 | 830° C., F.C. | 400 | 6 |
| | 70 | | 1280 | 32 |
| | 71 | | 1820 | 15 |
| | 72* | | 120 | 4 |
| 4621 | | | | |
| | 73 | | 3380 | 27 |
| | 74 | | 3140 | 26 |
| | 75 | | 5880 | 66 |
| | 76 | 850° C., A.C. | 3460 | 57 |
| | 77 | | 5440 | 66 |
| | 78* | | 1200 | 18 |

EXAMPLE II

Preparation of the steels were practiced in accordance with the same procedure as Example I except that the refining with Al was omitted.

Table V shows the chemical compositions of the prepared steels.

The molten steels were also cast into 1.3 ton ingots, and hot rolled under the same conditions as mentioned above.

Specimens for various tests were taken from the rolled steels thus obtained.

TABLE V

| Steel Mark | Run | C | Si | Mn | S | Te | %Te/%S | O | N | Al | Ni | Cr | Mo | B, V, Ti, Nb, Zr | Pb, Se, Bi, Ca | L/W |
|---|---|---|---|---|---|---|---|---|---|---|---|---|---|---|---|---|
| JIS S10C | | | | | | | | | | | | | | | | |
| | 1 | 0.09 | 0.20 | 0.44 | 0.030 | 0.007 | 0.233 | 0.0013 | 0.009 | 0.005 | — | — | — | — | — | 3.2 |
| | 2 | 0.11 | 0.19 | 0.49 | 0.025 | 0.010 | 0.400 | 0.0015 | 0.010 | 0.009 | — | — | — | Zr: 0.16 | — | 4.1 |
| | 3 | 0.10 | 0.20 | 0.43 | 0.030 | 0.002 | 0.066 | 0.0025 | 0.009 | 0.008 | — | — | — | — | Pb: 0.29 | 3.2 |
| | 4 | 0.09 | 0.19 | 0.50 | 0.025 | 0.007 | 0.280 | 0.0013 | 0.010 | 0.004 | — | — | — | — | Bi: 0.28 | 3.2 |
| | 5 | 0.11 | 0.21 | 0.42 | 0.034 | 0.019 | 0.559 | 0.0025 | 0.009 | 0.001 | — | — | — | Nb: 0.08 | Ca: 0.0033 | 4.1 |
| | 6 | 0.11 | 0.30 | 0.48 | 0.031 | 0.007 | 0.226 | 0.0014 | 0.010 | 0.002 | — | — | — | Ti: 0.08 | Pb: 0.15<br>Ca: 0.0014 | 3.6 |
| | 7* | 0.10 | 0.25 | 0.47 | 0.030 | — | — | 0.0112 | 0.010 | 0.032 | — | — | — | — | — | 21.5 |
| JIS S55C | | | | | | | | | | | | | | | | |
| | 8 | 0.56 | 0.19 | 0.66 | 0.011 | 0.005 | 0.455 | 0.0009 | 0.009 | 0.001 | — | — | — | — | — | 3.2 |
| | 9 | 0.55 | 0.20 | 0.69 | 0.010 | 0.006 | 0.600 | 0.0010 | 0.008 | 0.003 | — | — | — | B: 0.0010<br>Ti: 0.05 | — | 3.0 |
| | 10 | 0.56 | 0.16 | 0.67 | 0.004 | 0.014 | 3.500 | 0.0008 | 0.008 | 0.004 | — | — | — | Zr: 0.05 | — | 3.1 |
| | 11 | 0.55 | 0.18 | 0.83 | 0.012 | 0.006 | 0.500 | 0.0008 | 0.008 | 0.002 | — | — | — | Nb: 0.05<br>Ti: 0.01 | — | 3.3 |
| | 12 | 0.54 | 0.22 | 0.80 | 0.008 | 0.002 | 0.250 | 0.0014 | 0.008 | 0.008 | — | — | — | — | Pb: 0.04 | 3.3 |
| | 13 | 0.53 | 0.19 | 0.71 | 0.015 | 0.011 | 0.733 | 0.0010 | 0.009 | 0.007 | — | — | — | — | Pb: 0.04<br>Ca: 0.0079 | 3.3 |
| | 14 | 0.53 | 0.20 | 0.81 | 0.004 | 0.009 | 2.250 | 0.0009 | 0.009 | 0.009 | — | — | — | Zr: 0.03<br>Ti: 0.08 | Se: 0.074 | 3.4 |
| | 15 | 0.53 | 0.21 | 0.71 | 0.016 | 0.007 | 0.438 | 0.0011 | 0.009 | 0.006 | — | — | — | Nb: 0.03 | Ca: 0.0010 | 3.0 |
| | 16* | 0.56 | 0.19 | 0.68 | 0.013 | — | — | 0.0052 | 0.008 | 0.014 | — | — | — | — | — | 25.1 |
| | 17* | 0.56 | 0.19 | 0.77 | 0.015 | — | — | 0.0015 | 0.009 | 0.058 | — | — | — | B: 0.0052<br>Ti: 0.006 | — | 26.3 |
| JIS SMn21 | | | | | | | | | | | | | | | | |
| | 18 | 0.21 | 0.24 | 1.28 | 0.011 | 0.005 | 0.455 | 0.0009 | 0.010 | 0.006 | — | — | — | — | — | 3.9 |
| | 19 | 0.19 | 0.21 | 1.22 | 0.009 | 0.009 | 1.000 | 0.0012 | 0.010 | 0.007 | — | — | — | B: 0.0020<br>Ti: 0.05<br>Nb: 0.03 | — | 3.8 |
| | 20 | 0.21 | 0.24 | 1.28 | 0.015 | 0.018 | 1.200 | 0.0008 | 0.007 | 0.008 | — | — | — | Ti: 0.05 | — | 3.2 |
| | 21 | 0.21 | 0.25 | 1.22 | 0.010 | 0.006 | 0.600 | 0.0012 | 0.009 | 0.009 | — | — | — | — | Pb: 0.14<br>Bi: 0.04 | 3.3 |
| | 22 | 0.20 | 0.19 | 1.29 | 0.009 | 0.010 | 1.100 | 0.0014 | 0.010 | 0.006 | — | — | — | V: 0.19<br>Zr: 0.08 | Bi: 0.12<br>SE: 0.030 | 3.8 |
| | 23* | 0.22 | 0.23 | 1.26 | 0.014 | — | — | 0.0048 | 0.008 | 0.005 | — | — | — | — | — | 23.4 |

TABLE V-continued

| Steel Mark | Run | C | Si | Mn | S | Te | %Te/ %S | O | N | Al | Ni | Cr | Mo | B, V, Ti, Nb, Zr | Pb, Se, Bi, Ca | L/W |
|---|---|---|---|---|---|---|---|---|---|---|---|---|---|---|---|---|
| | 24* | 0.21 | 0.23 | 1.29 | 0.015 | — | — | 0.0044 | 0.025 | 0.005 | — | — | — | B: 0.0021 Ti: 0.05 | — | 23.0 |
| JIS SCr4 | | | | | | | | | | | | | | | | |
| | 25 | 0.38 | 0.21 | 0.70 | 0.012 | 0.009 | 0.750 | 0.0016 | 0.009 | 0.005 | — | 1.05 | — | — | — | 3.1 |
| | 26 | 0.41 | 0.25 | 0.69 | 0.029 | 0.018 | 0.621 | 0.0010 | 0.010 | 0.005 | — | 0.98 | — | B: 0.0030 Ti: 0.06 | — | 3.2 |
| | 27 | 0.38 | 0.21 | 0.69 | 0.014 | 0.019 | 1.357 | 0.0010 | 0.008 | 0.006 | — | 1.05 | — | V: 0.11 | — | 3.2 |
| | 28 | 0.38 | 0.20 | 0.70 | 0.013 | 0.002 | 0.154 | 0.0012 | 0.010 | 0.008 | — | 1.02 | — | Nb: 0.05 | — | 3.7 |
| | 29 | 0.40 | 0.25 | 0.69 | 0.009 | 0.018 | 2.000 | 0.0010 | 0.008 | 0.009 | — | 0.92 | — | — | Pb: 0.20 | 3.8 |
| | 30 | 0.41 | 0.18 | 0.70 | 0.028 | 0.002 | 0.071 | 0.0015 | 0.009 | 0.003 | — | 1.02 | — | — | Se: 0.061 | 3.2 |
| | 31 | 0.40 | 0.19 | 0.73 | 0.012 | 0.004 | 0.333 | 0.0008 | 0.008 | 0.002 | — | 1.08 | — | — | Bi: 0.03 Ca: 0.0070 | 3.5 |
| | 32 | 0.39 | 0.20 | 0.73 | 0.015 | 0.005 | 0.333 | 0.0009 | 0.007 | 0.004 | — | 1.18 | — | B: 0.0043 Ti: 0.05 | Ca: 0.0026 | 3.4 |
| | 33* | 0.42 | 0.23 | 0.78 | 0.029 | — | — | 0.0015 | 0.010 | 0.021 | — | 1.04 | — | — | — | 24.1 |
| | 34* | 0.43 | 0.21 | 0.71 | 0.014 | — | — | 0.0041 | 0.011 | 0.022 | — | 0.92 | — | B: 0.0044 Ti: 0.06 | — | 24.9 |
| | 35* | 0.40 | 0.22 | 0.75 | 0.015 | — | — | 0.0063 | 0.015 | 0.025 | — | 1.18 | — | V: 0.11 | — | 22.6 |
| JIS SNC2 | | | | | | | | | | | | | | | | |
| | 36 | 0.30 | 0.19 | 0.48 | 0.015 | 0.0009 | 0.600 | 0.0029 | 0.007 | 0.004 | 2.55 | 0.76 | — | — | — | 3.8 |
| | 37 | 0.29 | 0.30 | 0.40 | 0.025 | 0.003 | 0.120 | 0.0008 | 0.007 | 0.005 | 2.49 | 0.77 | — | B: 0.0050 | — | 4.0 |
| | 38 | 0.31 | 0.22 | 0.44 | 0.019 | 0.008 | 0.421 | 0.0009 | 0.009 | 0.004 | 2.43 | 0.69 | — | Nb: 0.04 Zr: 0.11 | — | 4.0 |
| | 39 | 0.30 | 0.25 | 0.41 | 0.020 | 0.003 | 0.150 | 0.0010 | 0.007 | 0.003 | 2.51 | 0.80 | — | — | Pb: 0.06 Se: 0.04 Ca: 0.0066 | 3.9 |
| | 40 | 0.28 | 0.19 | 0.40 | 0.019 | 0.009 | 0.474 | 0.0027 | 0.009 | 0.004 | 2.56 | 0.69 | — | Ti: 0.03 | Bi: 0.07 | 3.4 |
| | 41* | 0.34 | 0.18 | 0.51 | 0.027 | — | — | 0.0015 | 0.009 | 0.019 | 2.54 | 0.74 | — | — | — | 25.5 |
| JIS SNCM25 | 42 | 0.15 | 0.28 | 0.44 | 0.017 | 0.005 | 0.294 | 0.0009 | 0.008 | 0.006 | 4.18 | 0.85 | 0.24 | — | — | 3.3 |
| | 43 | 0.14 | 0.23 | 0.50 | 0.012 | 0.002 | 0.167 | 0.0020 | 0.011 | 0.007 | 4.30 | 0.72 | 0.23 | V: 0.02 Zr: 0.05 | — | 3.5 |
| | 44 | 0.14 | 0.23 | 0.49 | 0.020 | 0.001 | 0.050 | 0.0009 | 0.010 | 0.003 | 4.24 | 0.85 | 0.20 | Nb: 0.05 Ti: 0.06 Zr: 0.02 | Pb: 0.04 Se: 0.03 Ca: 0.0009 | 4.4 |
| | 45 | 0.14 | 0.22 | 0.39 | 0.013 | 0.008 | 0.615 | 0.0015 | 0.008 | 0.005 | 4.30 | 0.71 | 0.20 | — | Pb: 0.05 Se: 0.03 | 4.0 |
| | 46 | 0.16 | 0.22 | 0.50 | 0.012 | 0.005 | 0.417 | 0.0009 | 0.010 | 0.008 | 4.25 | 0.87 | 0.25 | B: 0.0029 Ti: 0.06 Nb: 0.03 | Ca: 0.0010 | 3.5 |
| | 47* | 0.16 | 0.31 | 0.43 | 0.008 | — | — | 0.0035 | 0.024 | 0.008 | 4.22 | 0.88 | 0.24 | — | — | 26.0 |
| JIS SCM22 | | | | | | | | | | | | | | | | |
| | 48 | 0.19 | 0.26 | 0.73 | 0.014 | 0.010 | 0.714 | 0.0015 | 0.008 | 0.009 | — | 1.04 | 0.29 | — | — | 3.3 |
| | 49 | 0.19 | 0.26 | 0.78 | 0.013 | 0.005 | 0.385 | 0.0015 | 0.009 | 0.006 | — | 1.11 | 0.29 | V: 0.03 | — | 3.0 |
| | 50 | 0.20 | 0.24 | 0.78 | 0.018 | 0.008 | 0.444 | 0.0014 | 0.008 | 0.007 | — | 1.04 | 0.19 | NB: 0.08 | — | 3.6 |
| | 51 | 0.21 | 0.26 | 0.72 | 0.013 | 0.002 | 0.154 | 0.0008 | 0.008 | 0.006 | — | 1.05 | 0.18 | — | Pb: 0.18 | 3.6 |
| | 52 | 0.21 | 0.21 | 0.73 | 0.033 | 0.011 | 0.333 | 0.0009 | 0.008 | 0.005 | — | 1.11 | 0.20 | — | Pb: 0.07 Ca: 0.0025 | 3.8 |
| | 53 | 0.20 | 0.21 | 0.73 | 0.018 | 0.008 | 0.444 | 0.0008 | 0.008 | 0.004 | — | 1.10 | 0.20 | — | Ca: 0.0044 | 3.0 |
| | 54 | 0.20 | 0.25 | 0.76 | 0.033 | 0.0027 | 0.818 | 0.0012 | 0.010 | 0.003 | — | 1.07 | 0.19 | Nb: 0.09 | Ca: 0.0030 | 3.0 |
| | 55 | 0.21 | 0.25 | 0.72 | 0.014 | 0.027 | 1.929 | 0.0015 | 0.010 | 0.002 | — | 1.11 | 0.29 | Nb: 0.06 | Se: 0.07 Ca: 0.0013 | 3.3 |
| | 56* | 0.21 | 0.22 | 0.74 | 0.020 | — | — | 0.0035 | 0.010 | 0.025 | — | 1.02 | 0.22 | — | — | 25.4 |
| | 57* | 0.21 | 0.23 | 0.75 | 0.022 | — | — | 0.0056 | 0.010 | 0.003 | — | 1.06 | 0.21 | Nb: 0.05 | Ca: 0.0012 | 24.9 |
| JIS SMnC3 | | | | | | | | | | | | | | | | |
| | 58 | 0.44 | 0.24 | 1.46 | 0.009 | 0.003 | 0.333 | 0.0010 | 0.007 | 0.007 | — | 0.55 | — | — | — | 4.1 |
| | 59 | 0.40 | 0.24 | 1.45 | 0.009 | 0.001 | 0.111 | 0.0010 | 0.0010 | 0.008 | — | 0.53 | — | B: 0.0022 Ti: 0.03 | — | 3.4 |
| | 60 | 0.43 | 0.25 | 1.44 | 0.014 | 0.002 | 0.143 | 0.0012 | 0.007 | 0.009 | — | 0.52 | — | V: 0.04 Nb: 0.08 Ti: 0.10 | — | 4.0 |
| | 61 | 0.42 | 0.25 | 1.46 | 0.009 | 0.004 | 0.444 | 0.0014 | 0.009 | 0.006 | — | 0.50 | — | — | Ca:0.0060 | 3.9 |
| | 62 | 0.42 | 0.23 | 1.41 | 0.013 | 0.010 | 0.769 | 0.0025 | 0.008 | 0.005 | — | 0.55 | — | — | Bi:0.02 Ca:0.0016 | 3.3 |
| | 63 | 0.42 | 0.26 | 1.49 | 0.011 | 0.005 | 0.455 | 0.0019 | 0.009 | 0.001 | — | 0.52 | — | Nb:0.03 | Pb:0.04 Bi:0.10 | 3.9 |
| | 64 | 0.43 | 0.25 | 1.41 | 0.011 | 0.010 | 0.909 | 0.0026 | 0.009 | 0.002 | — | 0.57 | — | Ti:0.02 Zr:0.13 | Se:0.10 | 3.8 |
| | 65* | 0.44 | 0.24 | 1.48 | 0.018 | — | — | 0.0017 | 0.009 | 0.021 | — | 0.54 | — | — | — | 23.6 |
| | 66* | 0.42 | 0.24 | 1.44 | 0.026 | — | — | 0.0056 | 0.010 | 0.025 | — | 0.53 | — | B:0.0058 Ti:0.06 | — | 25.1 |
| | 67 | 0.34 | 0.27 | 0.80 | 0.029 | 0.003 | 0.103 | 0.0010 | 0.011 | 0.009 | — | — | 0.26 | — | — | 4.0 |
| | 68 | 0.31 | 0.27 | 0.79 | 0.034 | 0.012 | 0.353 | 0.0008 | 0.008 | 0.008 | — | — | 0.25 | V:0.03 Ti:0.04 | — | 3.9 |
| | 69 | 0.30 | 0.28 | 0.81 | 0.037 | 0.013 | 0.351 | 0.0013 | 0.009 | 0.009 | — | — | 0.24 | Zr:0.09 | — | 3.9 |
| | 70 | 0.33 | 0.28 | 0.79 | 0.028 | 0.008 | 0.286 | 0.0010 | 0.011 | 0.006 | — | — | 0.24 | — | Pb:0.02 Bi:0.02 Ca:0.0008 | 4.4 |
| | 71 | 0.31 | 0.28 | 0.80 | 0.034 | 0.015 | 0.441 | 0.0009 | 0.011 | 0.005 | — | — | 0.26 | Nb:0.02 | Pb:0.23 | 3.8 |
| | 72* | 0.35 | 0.27 | 0.82 | 0.031 | — | — | 0.0015 | 0.011 | 0.025 | — | — | 0.24 | — | — | 22.8 |

TABLE V-continued

| Steel Mark | Run | C | Si | Mn | S | Te | %Te/%S | O | N | Al | Ni | Cr | Mo | B, V, Ti, Nb, Zr | Pb, Se, Bi, Ca | L/W |
|---|---|---|---|---|---|---|---|---|---|---|---|---|---|---|---|---|
| | 73 | 0.21 | 0.28 | 0.82 | 0.017 | 0.003 | 0.176 | 0.0013 | 0.008 | 0.003 | 1.77 | — | 0.25 | — | — | 4.0 |
| | 74 | 0.22 | 0.28 | 0.82 | 0.030 | 0.009 | 0.300 | 0.0011 | 0.008 | 0.009 | 1.83 | — | 0.23 | B:0.0086 Ti:0.03 Zr:0.03 | — | 3.5 |
| | 75 | 0.22 | 0.24 | 0.79 | 0.015 | 0.007 | 0.467 | 0.0013 | 0.009 | 0.006 | 1.84 | — | 0.25 | — | Pb:0.09 Ca:0.0016 | 4.1 |
| | 76 | 0.21 | 0.30 | 0.83 | 0.030 | 0.004 | 0.133 | 0.0010 | 0.008 | 0.008 | 1.77 | — | 0.25 | — | Ca:0.0035 | 3.6 |
| | 77 | 0.20 | 0.30 | 0.81 | 0.017 | 0.007 | 0.412 | 0.0012 | 0.009 | 0.002 | 1.78 | — | 0.23 | Zr:0.10 | Bi:0.05 Ca:0.0020 | 3.5 |
| | 78* | 0.20 | 0.31 | 0.85 | 0.039 | — | — | 0.0032 | 0.009 | 0.051 | 1.80 | — | 0.24 | — | — | 24.0 |

(1) Form of sulfide particles

In order to study the form of sulfide particles, the length (L) and width (W) of the particles were measured, and averages of the aspect ratios (L/W) were determined in accordance with the procedure of Example I. The values are shown in Table V.

The relation between the aspect ratios and the %Te/%S has the same tendency as obtained in Example I and shown in FIG. 1, i.e., a %Te/%S larger than 0.04 gives an aspect ratio smaller than 5.

(2) Formability in cold forging

The specimens were subjected to a heat treatment suitable to the steel (some were used as rolled), and test pieces were taken from the specimens. They were tested under the same conditions mentioned in Example I.

Occurrence of inner crack of the steels is shown in Table VI together with the heat treatment conditions. From the Table it is clearly seen that the occurrence of inner crack of the present steels is remarkably smaller than that of the comparative steels, thus showing improved formability in cold forging.

(3) Machinability

Machining tests were conducted using the specimens listed in Table VI under the machining conditions shown in Table III.

The results are given in Table VII.

TABLE VI

| Steel Mark | Run | Heat Treatment | Occurrence of Crack in Cold Forging (%) at various Reductions of height (%) 60 | 65 | 70 | 75 |
|---|---|---|---|---|---|---|
| JIS S10C | | | | | | |
| | 1 | | 0 | 0 | 0 | 0 |
| | 2 | | 0 | 0 | 0 | 0 |
| | 3 | | 0 | 0 | 0 | 0.3 |
| | 4 | As Rolled | 0 | 0 | 0.3 | 2.1 |
| | 5 | | 0 | 0 | 0 | 0 |
| | 6 | | 0 | 0 | 0.3 | 1.7 |
| | 7* | | 12.0 | 41.5 | 85.0 | 100 |
| JIS S55C | | | | | | |
| | 8 | | 0 | 0 | 0 | 9.0 |
| | 9 | | 0 | 0 | 0 | 6.1 |
| | 10 | | 0 | 0 | 0 | 4.7 |
| | 11 | Spheroidizing Annealing, | 0 | 0 | 0 | 7.5 |
| | 12 | 750° C.,F.C. | 0 | 0 | 0.3 | 9.5 |
| | 13 | | 0 | 0 | 0 | 7.0 |
| | 14 | | 0 | 0 | 0.7 | 9.0 |
| | 15 | | 0 | 0 | 0 | 5.0 |
| | 16* | Spheroidizing Annealing, | 9.5 | 35.0 | 87.0 | 100 |
| | 17* | 750° C.,F.C. | 0 | 29.5 | 76.5 | 100 |
| JIS SMn21 | | | | | | |
| | 18 | | 0 | 0 | 0 | 0.7 |

TABLE VI-continued

| Steel Mark | Run | Heat Treatment | Occurrence of Crack in Cold Forging (%) at various Reductions of height (%) 60 | 65 | 70 | 75 |
|---|---|---|---|---|---|---|
| | 19 | | 0 | 0 | 0 | 1.1 |
| | 20 | As Rolled | 0 | 0 | 0 | 0.2 |
| | 21 | | 0 | 0 | 0 | 3.7 |
| | 22 | | 0 | 0 | 0 | 4.7 |
| | 23* | | 11.0 | 12.5 | 62.5 | 97.0 |
| | 24* | | 6.5 | 25.0 | 75.5 | 100 |
| JIS SCr 4 | | | | | | |
| | 25 | | 0 | 0 | 0 | 4.7 |
| | 26 | Spheroidizing Annealing, | 0 | 0 | 0 | 6.5 |
| | 27 | 770° C.,F.C. | 0 | 0 | 3.5 | 13.0 |
| | 28 | | 0 | 0 | 0 | 5.0 |
| | 29 | | 0 | 0 | 0 | 13.5 |
| | 30 | | 0 | 0 | 0 | 7.0 |
| | 31 | Spheroidizing Annealing, | 0 | 0 | 0 | 6.1 |
| | 32 | 770° C., F. C. | 0 | 0 | 0 | 5.1 |
| | 33* | | 0 | 53.0 | 91.5 | 100 |
| | 34* | | 22.0 | 35.5 | 77.5 | 100 |
| | 35* | | 14.5 | 29.0 | 78.0 | 100 |
| JIS SNC2 | | | | | | |
| | 36 | Annealing, 820° C. FC | 0 | 0 | 0 | 0 |
| | 37 | | 0 | 0 | 0 | 0 |
| | 38 | | 0 | 0 | 0.3 | 4.1 |
| | 39 | | 0 | 0 | 0 | 3.0 |
| | 40 | | 0 | 0 | 0 | 3.1 |
| | 41* | | 0 | 15.5 | 62.5 | 100 |
| JIS SNCM25 | | | | | | |
| | 42 | | 0 | 0 | 0 | 0 |
| | 43 | As Rolled | 0 | 0 | 0 | 0 |
| | 44 | | 0 | 0 | 0 | 1.8 |
| | 45 | As rolled | 0 | 0 | 0 | 4.1 |
| | 46 | | 0 | 0 | 0 | 7.1 |
| | 47* | | 5.5 | 7.5 | 33.0 | 79.5 |
| JIS SCM 22 | | | | | | |
| | 48 | | 0 | 0 | 0 | 0 |
| | 49 | | 0 | 0 | 0 | 0 |
| | 50 | | 0 | 0 | 0 | 0 |
| | 51 | As Rolled | 0 | 0 | 0 | 5.0 |
| | 52 | | 0 | 0 | 0 | 0.9 |
| | 53 | | 0 | 0 | 0 | 0 |
| | 54 | | 0 | 0 | 0 | 0 |
| | 55 | | 0 | 0 | 0 | 9.0 |
| | 56* | | 14.0 | 22.0 | 61.0 | 98.5 |
| | 57* | | 25.0 | 47.5 | 75.0 | 100 |
| JIS SMnC3 | | | | | | |
| | 58 | | 0 | 0 | 0 | 6.1 |
| | 59 | | 0 | 0 | 0 | 9.0 |
| | 60 | | 0 | 0 | 0 | 10.0 |
| | 61 | Spheroidizing Annealing, | 0 | 0 | 0 | 6.1 |
| | 62 | 750° C., F.C. | 0 | 0 | 2.5 | 17.1 |
| | 63 | | 0 | 0 | 0 | 11.5 |
| | 64 | | 0 | 0 | 0 | 10.5 |
| | 65* | | 0 | 48.0 | 86.0 | 100 |
| | 66* | | 35.0 | 63.5 | 99.0 | 100 |
| 4032 | | | | | | |
| | 67 | | 0 | 0 | 0 | 10.1 |
| | 68 | | 0 | 0 | 0 | 13.0 |
| | 69 | Annealing, | 0 | 0 | 0 | 9.0 |

TABLE VI-continued

| Steel Mark | Run | Heat Treatment | Occurrence of Crack in Cold Forging (%) at various Reductions of height (%) 60 | 65 | 70 | 75 |
|---|---|---|---|---|---|---|
| | | 830° C., F.C. | | | | |
| | 70 | | 0 | 0 | 0.3 | 17.0 |
| | 71 | | 0 | 0 | 0.9 | 20.0 |
| | 72* | | 45.0 | 82.0 | 100 | 100 |
| 4621 | | | | | | |
| | 73 | | 0 | 0 | 0 | 0 |
| | 74 | | 0 | 0 | 0 | 0 |
| | 75 | As Rolled | 0 | 0 | 0 | 1.7 |
| | 76 | | 0 | 0 | 0 | 0 |
| | 77 | | 0 | 0 | 0 | 3.1 |
| | 78* | | 39.5 | 45.0 | 100 | 100 |

TABLE VII

| Steel Mark | Run | Heat Treatment | Tool Life of Hss Twist Drill (mm) | Tool Life of Carbide single point Tool (min.) |
|---|---|---|---|---|
| JIS S10C | | | | |
| | 1 | | 39,000 | 52 |
| | 2 | | 32,800 | 50 |
| | 3 | | 98,100 | 56 |
| | 4 | 900° C., A.C. | 93,400 | 52 |
| | 5 | | 36,600 | 122 |
| | 6 | | 57,000 | 124 |
| | 7* | | 13,000 | 35 |
| JIS S55C | | | | |
| | 8 | | 380 | 15 |
| | 9 | | 340 | 15 |
| | 10 | | 300 | 14 |
| | 11 | 850° C., A.C. | 320 | 16 |
| | 12 | | 540 | 23 |
| | 13 | | 480 | 50 |
| | 14 | | 560 | 19 |
| | 15 | | 360 | 46 |
| | 16* | 850° C., A.C. | 100 | 10 |
| | 17* | | 80 | 9 |
| JIS SMn21 | | | | |
| | 18 | | 3,600 | 21 |
| | 19 | | 3,380 | 20 |
| | 20 | | 3,360 | 20 |
| | 21 | 880° C., A.C. | 6,840 | 35 |
| | 22 | | 5,880 | 21 |
| | 23* | | 1,200 | 13 |
| | 24* | | 1,140 | 12 |
| JIS SCr4 | | | | |
| | 25 | | 380 | 35 |
| | 26 | | 380 | 36 |
| | 27 | 830° C., F.C. | 360 | 32 |
| | 28 | | 340 | 36 |
| | 29 | | 1,260 | 43 |
| | 30 | | 660 | 37 |
| | 31 | 830° C., F.C. | 600 | 85 |
| | 32 | | 380 | 80 |
| | 33* | | 120 | 22 |
| | 34* | | 120 | 22 |
| | 35* | | 80 | 20 |
| JIS SNC2 | | | | |
| | 36 | | 600 | 17 |
| | 37 | | 620 | 17 |
| | 38 | 850° C., A.C. | 500 | 18 |
| | 39 | | 740 | 57 |
| | 40 | | 660 | 30 |
| | 41* | | 180 | 10 |
| JIS SNCM25 | | | | |
| | 42 | | 3,300 | 26 |
| | 43 | 850° C., A.C. | 2,980 | 24 |
| | 44 | | 2,760 | 23 |
| | 45 | 850° C., A.C. | 5,000 | 58 |
| | 46 | | 4,980 | 32 |
| | 47* | | 940 | 15 |
| JIS SCM22 | | | | |
| | 48 | | 5,460 | 45 |
| | 49 | | 5,180 | 45 |
| | 50 | | 5,360 | 46 |
| | 51 | | 18,800 | 60 |
| | 52 | 870° C., A.C. | 9,400 | 56 |

TABLE VII-continued

| Steel Mark | Run | Heat Treatment | Tool Life of Hss Twist Drill (mm) | Tool Life of Carbide single point Tool (min.) |
|---|---|---|---|---|
| | 53 | | 5,600 | 95 |
| | 54 | | 5,140 | 92 |
| | 55 | | 7,820 | 106 |
| | 56* | | 1,720 | 29 |
| | 57* | | 1,680 | 40 |
| JIS SMnC3 | | | | |
| | 58 | 870° C., F.C. | 320 | 12 |
| | 59 | | 280 | 10 |
| | 60 | | 300 | 10 |
| | 61 | 870° C., F.C. | 340 | 16 |
| | 62 | | 400 | 20 |
| | 63 | | 1,000 | 18 |
| | 64 | | 640 | 14 |
| | 65* | | 80 | 5 |
| | 66* | | 80 | 4 |
| 4032 | | | | |
| | 67 | | 460 | 9 |
| | 68 | 830° C., F.C. | 420 | 8 |
| | 69 | | 400 | 8 |
| | 70 | | 1,320 | 33 |
| | 71 | | 1,980 | 16 |
| | 72* | | 120 | 4 |
| 4621 | | | | |
| | 73 | | 3,380 | 27 |
| | 74 | | 3,260 | 28 |
| | 75 | 850° C., A.C. | 5,980 | 68 |
| | 76 | | 3,500 | 62 |
| | 77 | | 5,440 | 68 |
| | 78* | | 1,200 | 18 |

We claim:

1. A method of making a steel for cold forging having good machinability containing:

C up to 0.6%,
Si up to 0.5%,
Mn up to 2.0%,
S 0.003 to 0.04%, and
Te up to 0.03%, wherein ratio %Te/%S being at least 0.04, and further, Al 0.01 to 0.04%,
N up to 0.02% and
O up to 0.0030%, and optionally, at least one of the alloying elements selected from the group of:

Ni up to 4.5%,
Cr up to 3.5%, and
Mo up to 1.0%, at least one of the alloying elements selected from the group of:

V up to 2.0%,
Nb up to 0.5%,
Ti up to 0.5%,
B up to 0.01% and
Zr up to 0.5%, and at least one of the alloying elements selected from the group of:

Pb 0.01 to 0.3%
Se 0.003 to 0.10%,
Bi 0.01 to 0.30% and
Ca 0.0002 to 0.01%, and the balance being substantially Fe, which method comprises the steps of:

preparing a molten steel containing the predetermined amounts of C, Si, Mn and S in a furnace or a ladle, at the time of refining by addition of Al to the molten steel during or after vacuum degassing, introducing non-oxidizing gas in the molten steel for forceable stirring so that large-sized particles of non-metallic inclusions may float up and separate, and adding Te, and, if necessary, Pb, Bi or Ca to the molten steel to disperse the elements uniformly therein.

* * * * *